United States Patent [19]

Suda et al.

[11] 4,325,752

[45] Apr. 20, 1982

[54] METHOD FOR MAKING SHADOW MASKS

[75] Inventors: Toyoharu Suda, Kawasaki; Katsuhiko Tayama, Yokohama; Kenji Araki, Yokohama; Masayuki Kurata, Yokohama; Hideo Yamana, Kawasaki, all of Japan

[73] Assignees: Nippon Kokan Kabushiki Kaisha; Nippon Mining Co., Ltd., both of Tokyo, Japan

[21] Appl. No.: 177,924

[22] Filed: Aug. 13, 1980

[30] Foreign Application Priority Data

Aug. 22, 1979 [JP] Japan ..... 54-107024

[51] Int. Cl.[3] ..... C21G 9/00

[52] U.S. Cl. ..... 148/12.1

[58] Field of Search ..... 148/12 C, 12 F, 12.1

[56] References Cited

U.S. PATENT DOCUMENTS 3,510,366 5/1970 Mears ..... 148/12.1

3,909,311 9/1975 Yamada et al. ..... 148/12.1

*Primary Examiner*—W. Stallard

*Attorney, Agent, or Firm*—Frishauf, Holtz, Goodman & Woodward

[57] ABSTRACT

Al killed cold rolled sheet is manufactured. The sheet is composed of

C: less than 0.01%, Mn: 0.10–1.00%, S: less than 0.025%, Sol.Al: 0.010–0.120%, N: less than 100 ppm, balance being Fe and impurities.

The above N and Sol. Al are in relation of Sol-.Al/N×14/27≧1.5 and most of the N is further fixed as AlN. The Al killed cold rolled sheet is re-rolled to a thickness below 0.2 mm and bored by photo-etching. Then the sheet is finally annealed in a decarburizing atmosphere at temperatures in the range of 650–850° C. for 1–30 minutes, preferably 1–10 minutes. Subsequently the sheet is subjected to a leveling process and press forming to form a shadow mask for color TV.

5 Claims, 3 Drawing Figures

METHOD FOR MAKING SHADOW MASKS

BACKGROUND OF THE INVENTION

1. Field of the Invention

The present invention relates to a method for making shadow masks to be incorporated in the cathode ray tube for color TV.

2. Description of the Prior Art

The shadow mask is manufactured by the following process. The normally produced cold-rolled steel sheet is subjected to re-cold roll to be less than 0.2 mm in thickness. Such re-rolled sheet is bored through in a photo-etching process and is then annealed at 650°–950° C. for a short period of time (hereinafter referred to as "final annealing"). The leveller process follower to decrease yield point elongation (Y.P.El) which causes stretcher strain, and to correct the shape of the steel sheet. Finally, the sheet is pressed into a shape corresponding to a front curve of the cathode ray tube.

In relation to the above mentioned shadow mask making process, the inventors have found that Al-killed ultralow C and cold rolled sheet including C and solute N in minimal amounts the is superior in photo-etching characteristics and press-formability, and is as a whole more suitable as the material for the shadow masks in comparison with the rimmed steel. The inventors have already proposed in Japanes patent application No. 53-133245 the method for making shadow maskes using a material of such Al killed ultra-low C cold rolled sheet.

SUMMARY OF THE INVENTION

The required characteristics with respect to the press formability are to be low in yield point stress (Y.P. Stress) and yield point elongation (Y.P.El). It is known experientially that Y.P.Stress is to be below 17 kg/mm2, and Y.P.El is to be below 3%.

However even such treated Al-killed steel still often shows high Y.P.El after the final annealing so that it is unstable in the press-forming.

The object of the present invention is to develop and improve the said proposed invention in this regard for the purpose of providing further superiority in the press-formability characteristics.

Method of the present invention comprises, making Al killed steel, re-cold rolling, photoetching, finally annealing and pressing the Al-killed steel.

The Al killed steel is produced through hot rolling, cold rolling and annealing a usual slab or, in addition, temper-rolling it, to contain C: less than 0.01%, Mn: 0.10–1.00%, S: less than 0.025%, Sol. Al: 0.010–0.120%, N: less than 100 ppm, balance being Fe and unavoidable impurities, and, wherein the above-mentioned N and Sol. Al satisfy the relationship of $Sol.Al/N \times 14/27 \geqq 1.5$, and also most of the N is fixed as AlN.

Then the final annealing is carried out in a decarburizing atmosphere at 650°–850° C. for 1–30 minutes, preferably for 1–10 minutes.

DETAILED DESCRIPTION OF THE INVENTION

Figure 1:
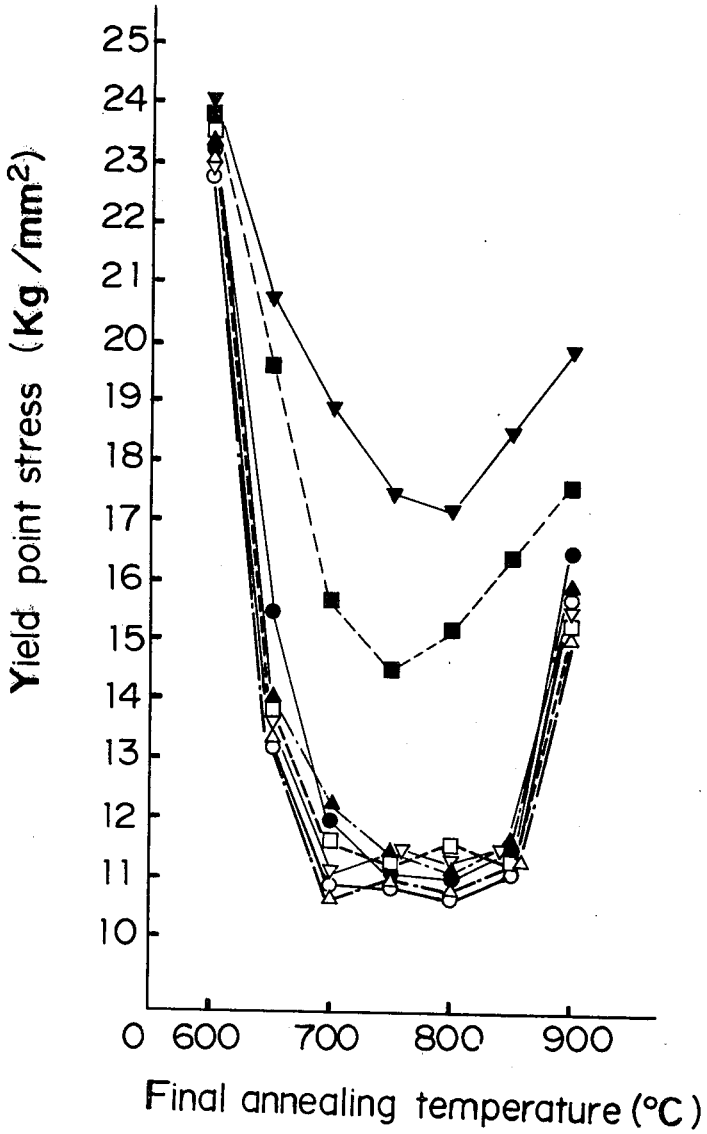
FIG. 1 is a graph showing the relation between Y.P.Stress and the final annealing temperatures.

Al-killed cold rolled steel sheet is manufactured by hot-rolling a usually produced slab (the finishing temperaures of above 820° C. is preferred), coiling (the coiling temperatures in the range of 480°–800° C. is preferable), and cold rolling (reduction is above 40%) followed by pickling and finally annealing the slab at 540°–850° C. of steel temperatures.

The chemical composition of the Al killed cold rolled sheet is defined as follows.

C: C is less than 0.01% because high C content take a long time for decarbonization in the final annealing. To reduce the C content to less than 0.01%, a vacuum degasing treatment may be utilized for the molten steel. A decarbonizing annealing also may be employed as the annealing for making the cold-rolled sheet.

Mn: Mn is in the range of 0.10–1.00% in consideration of deoxidation, avoiding hot brittleness by S, satisfying $Mn/S > 15$ and further cost saving.

S: A minimum content of S is preferred, as S above 0.025% causes an increase in the Mn S-inclusions and affects the shape of holes made in the shadow maskes.

Al: Al is set so as to extremely decrease oxide-inclusions by strong deoxidizing action in the steel making, to improve photo-etching characteristics and further to fix solute N as AlN on account of causing Y.P.El to be large.

According to the inventors experiments, and investigations, Al addition is needed to satisfy the relation of $Sol.Al/N \times 14/27 \geqq 1.5$.

To satisfy the above relation, Al is added above 0.010% as Sol.Al with regard to the N content, but the maximum Al content is limited to 0.120% because Al content higher than desired caused higher production cost, and makes the flowing of molten steel worse and makes non-metallic inclusions difficult to float up.

N: N content is preferred to be as low as possible, since it increases Y.P.El. N is limited to less than 100 ppm, because N does not exceed 100 ppm except being added in the ordinary process. In the present invention, most of the N shall be fixed as AlN.

Two ways are known to fix N as AlN. One is to adjust the coiling temperatures in hot-rolling and the other is to perform the box annealing at temperatures of 650°–800° C. When the decarburizing treatment is carried out in the box annealing process to make the cold rolled sheet of C content less than 0.1%, it is sufficient to fix solute N as AlN by the annealing in above mentioned temperature range. In this case, the said coiling at high temperatures in the hot rolling process is not always needed and the coiling is well enough when carried out at low temperatures.

When the vacuum degassing treatment is employed to decrease C to less than 0.01%, the coiling is preferred to be carried out at high temperatures. In this case, the subsequent annealing is sufficient to only provide recrystallization, and therefore it may depend upon the continuous annealing or the box annealing. The annealing temperatures therefore have to be selected in the range of 540°–800° C. of the steel, because if below 540°

C. the recrystallization does not take place, and if above 800° C. AlN precipitated at coiling can be subject to re-solution.

Since denitronization in the box annealing decreases solute N in steel, the amount of Al which is added can be decreased accordingly.

The ultra low C cold rolled sheet (steel band) controlled to be with the above composition is again cold-rolled (above 40% of reduction to a thickness below 0.2 mm and bored in the photo-etching in the usual shadow mask making process. The final annealing and the press-forming process follow it. It is necessary to employ the substantially decarburized Al killed ultra low C cold rolled sheet for improving the press formability.

However, insufficiently or non-uninformly decarburized ultra low C cold rolled steel sheet happens to be manufactured in the ordinary process. That is because even the steel sufficiently decarbonized by the vacuum degassing treatment will be carburized by ferromanganese or the like in the subsequent controlling process of adding ferro-alloy. The decarburization by the open coil annealing process sometimes causes partially insufficient decarburization by dispersion of the decarburizing strength, or contact of strips with each other.

The inventors repeated many experiments and investigations and found out that it is substantially effective to finally anneal the sheet in a decarburizing atmosphere at 650°-850° C. of annealing temperatures for 1-30 minutes, preferably for 1-10 minutes to exactly obtain the superiority in the press formability.

Such annealing in a decarburizing atmosphere is to compensate the inefficiency of decarburization which often arise in the usual decarburizing treatment, and to avoid the phenomenon of the carburization which will appear in the final annealing process.

The decarburizing atmosphere referred to herein is not defined beyond the meaning of the non-oxidizing atmosphere wherein decarburization can occur. For example, the atmosphere used in the open-coil annealing furnace utilized in the general process for making decarburized cold rolled sheets are suitable therefor. A vacuum is also suitable because the thickness of the sheets is small. The above range of temperatures are set because efficient decarburizing is not performed below 650° C. for the above defined time, and above 850° C. solute N can increase. The above annealing time is defined because no effect of annealing appears in a shorter time then 1 minute, and resolution of AlN increases greatly to make the press formability worse in the annealing at temperatures above 750° C. for time more than 30 minutes. Such re-solution of AlN starts to increase in the annealing after 10 minutes, and annealing for 1-10 minutes is preferred.

Reference will be made to example of the present invention hereunder.

EXAMPLE

Test pieces were Al-killed ultra low C cold rolled steel manufactured with sufficiently treating the continuously cast slab, of finish rolling at 850° C., coiling at 520° C., cold rolling of 77% after pickling, and annealing at 750° C.

The composition of the test pieces are shown in the below table.

COMPOSITION OF TEST PIECES

| Test Pieces | C (Wt %) | Si | Mn | P | S | Sol.Al | N | O | $\frac{Sol.Al}{N} \times \frac{14}{27}$ |
|---|---|---|---|---|---|---|---|---|---|
| A | 0.002 | 0.03 | 0.27 | 0.012 | 0.010 | 0.045 | 0.0057 | 0.0079 | 4.09 |
| B | 0.003 | 0.03 | 0.28 | 0.013 | 0.014 | 0.037 | 0.0045 | 0.0045 | 4.26 |
| C | 0.005 | 0.02 | 0.30 | 0.011 | 0.009 | 0.047 | 0.0043 | 0.0027 | 5.67 |
| D | 0.009 | 0.02 | 0.28 | 0.016 | 0.016 | 0.044 | 0.0038 | 0.0036 | 6.00 |

Figure 2:
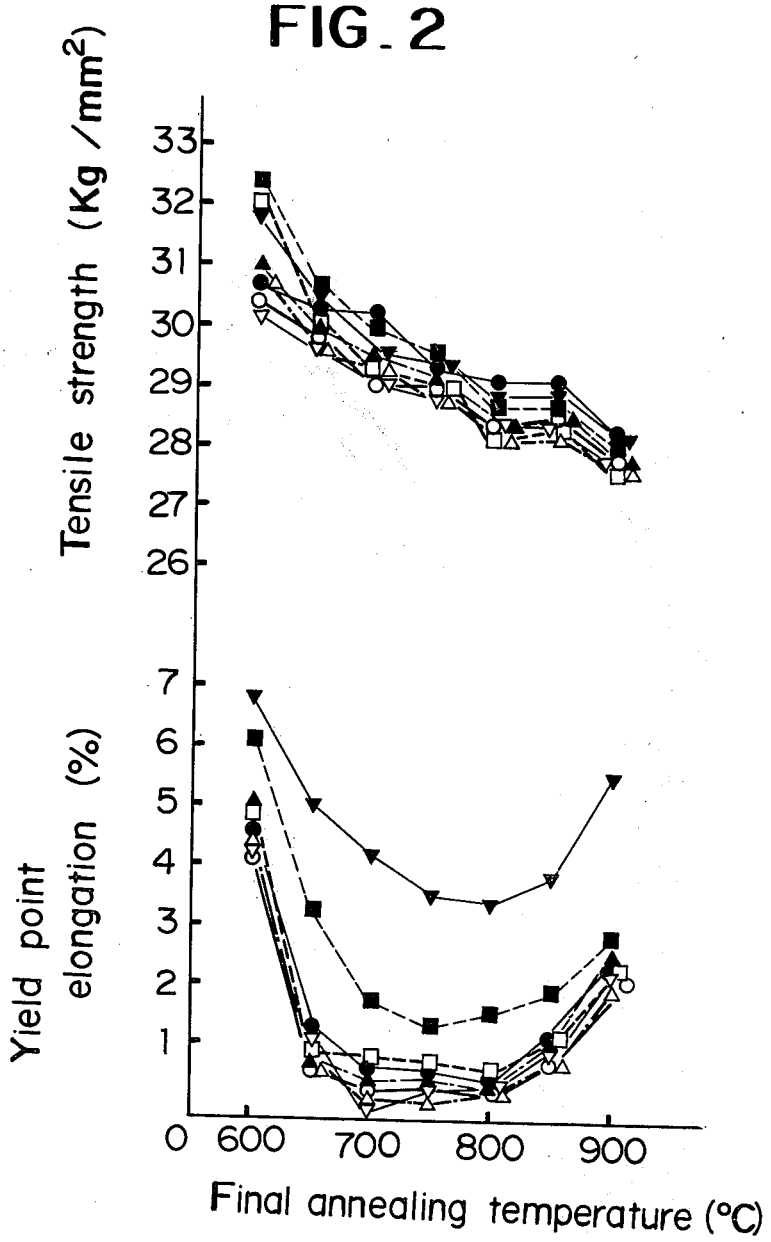
FIG. 2 is a graph showing the relation between the final annealing temperatures, and Y.P.El and Tensile strength.
Figure 3:
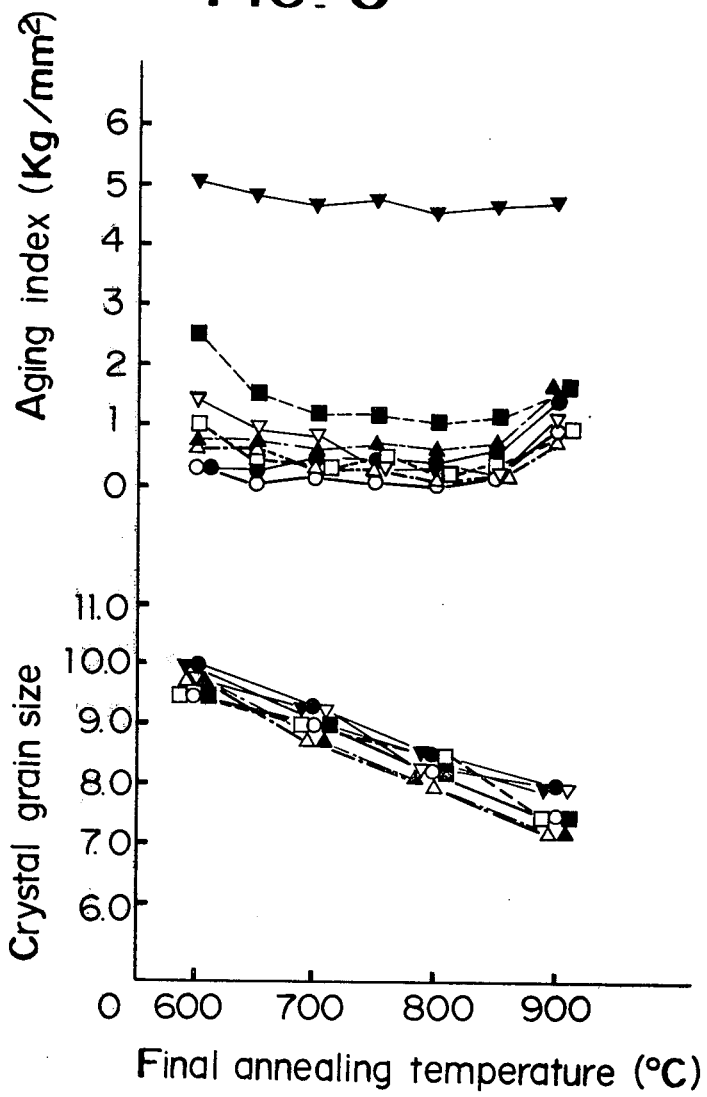
FIG. 3 is a graph showing the relation between the final annealing temperatures, aging index and grain size.

Such test pieces were further cold rolled 75% to 0.18 mm in thickness. After that, some of test pieces were finally annealed at 600° to 900° C. for 10 minutes in a decarburizing atmosphere, the remainder of the test pieces were finally annealed for 10 minutes in a non-decarbonizing atmosphere. The test pieces were subject to the tension test at the room temperature, the aging test and the measurement of grain size, the results of which are shown in FIG. 1-FIG. 3. Marks in FIGS. 1-3 respectively indicate as follows.

| Atmosphere in final annealing | Test pieces | Mark |
|---|---|---|
| Non-oxidizing and decarburizing atmosphere (The present invention) | Ⓐ | —○— |
| | Ⓑ | - - □ - - |
| | Ⓒ | - - △ - - |
| | Ⓓ | —▽— |
| Non-oxidizing and Non-decarburizing atmosphere (The conventional method) | Ⓐ | —●— |
| | Ⓑ | - - ■ - - |
| | Ⓒ | - · ▲ - - |
| | Ⓓ | —▼— |

Marks Ⓐ, Ⓑ and Ⓒ represent Al-killed ultra low C cold rolled sheet manufactured by the open coil annealing, the C content of which are 0.002%, 0.003% and 0.005% respectively.

Mark Ⓓ represents Al killed ultra low C cold rolled sheet decarbonized by the vacuum degassing treatment, the C content of which is 0.009%.

It is seen from FIGS. 1 and 2 that the test pieces annealed in non-decarburizing atmosphere show wide variation of Y.P.Stress and Y.P.El. It is apparent from FIG. 3 that the inventive test pieces show superior characteristics of lower Y.P.El, Y.P.Stress and more stability of grain size than such conventional test pieces despite that they are respectively made of variable C cold rolled sheets. This is due to the final annealing in a decarburizing atmosphere at the range of 650°-850° C. for the short period of time.

The test piece Ⓑ annealed in non-decarburizing atmosphere show high Y.P.El and Y.P.Stress despite the C content of the material is low level of 0.003%. This is assumed due to the carburization by the extremely small amount of carbon and chemical compound of carbon remained in the surface of the sheet.

The aging index of steel generally depends on the amount of solute N and C, i.e. the index is high for a large amount of solute C and N, and low for a small amount of solute C and N. The aging index of the steel of the present invention depends on the amount of solute C since solute N is almost entirely fixed as AlN.

Thus the low aging index means that the steel is sufficiently decarburized and the C content is stable at low level, consequently the press formability is excellent. FIG. 3 shows that the aging index in the present invention is stable below 1.0 The method of the present invention can exactly provide excellent press formability and may make it possible to omit the leveller process to be carried out before the press forming, since on the steel as a low Y.P.El value.

We claim:

1. A method for making shadow masks comprising, making an Al killed cold rolled steel sheet which consists essentially of C: less than 0.01%, Mn: 0.10–1.00%, S: less than 0.025%, Sol.Al: 0.010–0.12%, N: less than 100 ppm, the remainder being Fe and unavoidable impurities, where N and Sol. Al have the relationship of Sol.Al/N$\times$14/27$\geqq$1.5 and most of the N is fixed as AlN, re-rolling the said sheet to a thickness below 0.2 mm, photo-etching the steel to bore holes through it, and final annealing the sheet in a decarbonizing atmosphere at temperatures in the range of 650°–850° C. for 1–30 minutes, then leveling the steel and press forming it.

2. The method of claim 1 wherein the final annealing is carried out for 1–10 minutes.

3. The method of claim 1 or 2, further comprising vacuum degassing molten steel during the manufacture of said Al killed cold-rolled steel sheet to decrease the C content to below 0.01%, and coiling at high temperatures to fix most of solute N as AlN.

4. The method of claim 1 or 2, further comprising decarburizing annealing in a box annealing furnace at temperatures in the range of 650°–800° C. to decrease the C content below 0.01% and to fix most of the N as AlN.

5. The method of claim 1, further comprising carrying out the final annealing in a box annealing furnace and carrying out denitrogenization in said box annealing furnace.

* * * * *